US007121312B2

(12) United States Patent
Yu

(10) Patent No.: US 7,121,312 B2
(45) Date of Patent: Oct. 17, 2006

(54) GLUE TAPE CUTTER

(76) Inventor: Tzu-Chen Yu, 17 Lane 134, Thu-Pi Road, Feng-Yuan (TW) 420

( * ) Notice: Subject to any disclaimer, the term of this patent is extended or adjusted under 35 U.S.C. 154(b) by 114 days.

(21) Appl. No.: 10/797,067

(22) Filed: Mar. 11, 2004

(65) Prior Publication Data

US 2005/0199345 A1 Sep. 15, 2005

(51) Int. Cl.
*B32B 38/04* (2006.01)
*B65C 1/04* (2006.01)

(52) U.S. Cl. ..... 156/459; 156/527; 156/574; 156/576; 156/577; 225/22; 225/33; 225/66; 225/89

(58) Field of Classification Search ..... 156/574, 156/576, 579, 577, 523, 527, 443, 459, 468; 225/21, 22, 25, 33, 56, 66, 72, 89, 91; 493/352, 493/353, 466
See application file for complete search history.

(56) References Cited

U.S. PATENT DOCUMENTS 3,810,567 A * 5/1974 Malcolm ..... 493/353
4,816,109 A * 3/1989 Ingram ..... 156/443
4,824,427 A * 4/1989 Smillie, III ..... 493/353
4,944,720 A * 7/1990 Suhr ..... 493/466
5,662,578 A * 9/1997 Phelps ..... 493/353

OTHER PUBLICATIONS

Merriam-Webster's Collegiate Dictionary, 1998, Merriam-Webster, Inc., Tenth Edition, p. 591.*

* cited by examiner

*Primary Examiner*—Mark A. Osele

(57) ABSTRACT

A glue tape cutter includes a cutting table, a press plate, a holding blade, a cutting base, a knife blade and a shaft. The curved substrate is disposed at the bottom of the cutting table and the holding blade is fixed to the cutting table above the curved substrate. The cutting base is rotationally attached to the cutting table by way of the shaft being attached to the lateral covers of the cutting table. The knife blade is attached to the upper part of the cutting base and the holding blades are fixed to the cutting table above the press plate. Once the cutting base rotates, the glue tape can produce an adhered reversed fold part for the user easily tearing up the glue tape adhered to the paper box.

1 Claim, 2 Drawing Sheets

GLUE TAPE CUTTER

BACKGROUND OF THE INVENTION

1. Field of the Invention

The present invention is related to a glue tape cutter and particularly to an improvement on the glue tape cutter.

2. Brief Description of Related Art

Presently, a paper box is mostly sealed with glue tapes and there are two kinds glue tape cutters, the hand held cutter and the cutting stand, available in the market. The hand held cutter is used for the wide glue tape, which is for sealing the paper box, and the cutting stand is used for being placed on a desk or a table while in use.

Although the currently used hand held cuter for the glue tape provides basic function for quickly sealing paper boxes with facility, there are a lot of disadvantages, which are listed hereinafter, needed to be overcomes.

1. The glue tape, which is placed in front of the knife blade, is easy to be apart from the fixing position and result in the glue tape sticking itself or adhering to the cutter or any other articles. When the glue tape is ready to be used, the adhered part has to be torn apart in advance. However, it is very possible for the glue tape being torn in two strip halves or even adhering to the hand to occur inconvenience before using and to waste the glue tape.

2. The glue tape is excessive long in front of the knife blade even if the glue tape keeps staying in place such that the glue tape becomes reversed fold to adhere itself and the cutter. As a result, it is inconvenient while in use and it is hard to be torn apart and even bring to a great deal of wasted glue tape.

3. The glue tape frequently adheres the hand and it is not easy to be peeled off to affect sealing work efficiency done by the user and the mood of the user due to the user keeping peeling the glue tape on the hand.

4. It is necessary to use a knife or the like for cutting apart the glue tape sealed on the paper box in case of the sealed paper box having to be opened. Otherwise, it is difficult to open the sealed paper box without the opening tool.

5. Due to the glue tape often residing on the waste paper box, it results in difficulty of classification for resource recycle.

SUMMARY OF THE INVENTION

The crux of the present invention resides in that two sets of cutting tools are provided in the glue tape cutter, one for cutting the glue tape and the other one for retaining the glue tape. The tool for cutting the glue tape is arranged to rotate and the tool for retaining the glue tape can pierce and hold the glue tape while the glue tape is cut and seals the paper box. After cutting the glue tape, the cutting tool rotates to draw and fold the glue tape and the pierced and held part of the glue tape is kept unmoved such that the folded part exceeds the held part and adheres the held part.

An object of the present invention is to provide a glue tape cutter for avoiding inconvenience while in use and decreasing waste of the glue tape due to improper adhesion.

Another object is to provide a glue tape cutter with which the sealed glue tape can be torn easily.

A further object is to provide a glue tape cutter with which the sealed glue tape can be torn apart from the paper box to facilitate resource recycle.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
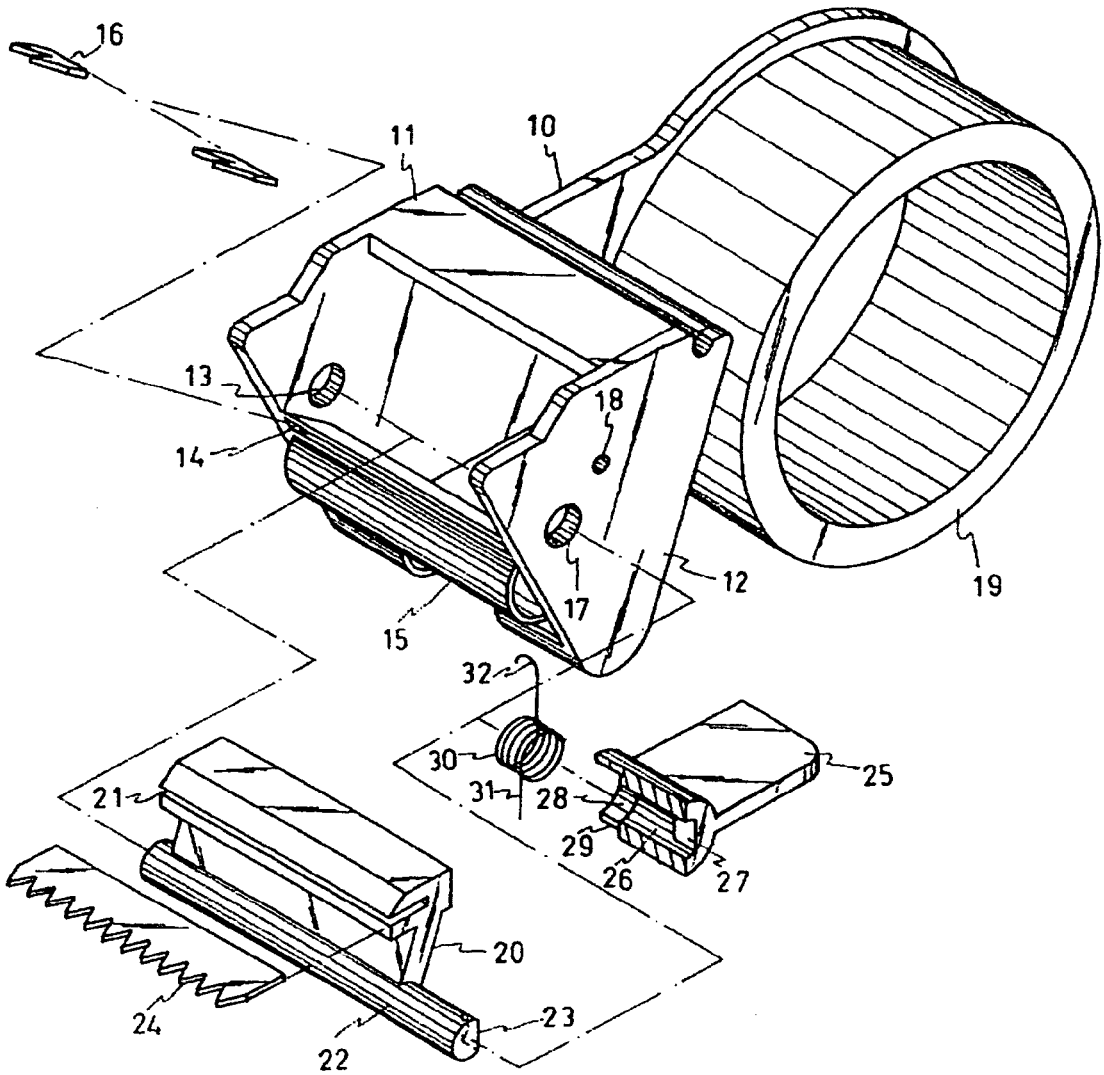
FIG. 1 is an exploded perspective view of the glue cutter according the present invention.
Figure 2:
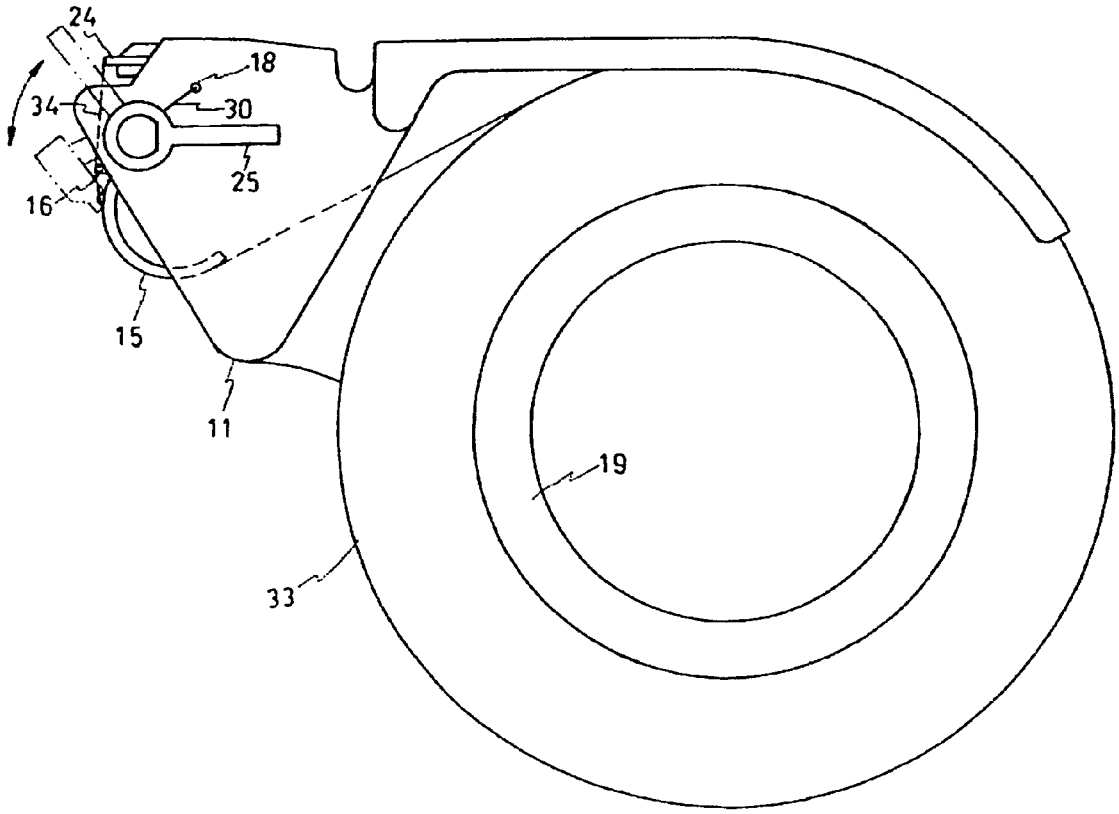
FIG. 2 is a perspective view of the glue cutter shown in FIG. 1.

Referring to FIGS. 1 and 2, a glue cutter according to the present invention includes a cutting table 11 and a cutting base 20. The cutting base 20 is attached to the front side of the cutting table 11. The cutting table 11 has at a lateral side thereof a side cover with an axial hole 13 and at the bottom thereof a locating groove 14 and a curved substrate 15. At least a holding blade 16 is received in the locating groove 14 with both ends thereof having a projecting edge respectively. The cutting table 11 has at another lateral side thereof a side cover 12 with an axial hole 17 and an aperture 18. The cutting base 20 is provided with a shaft 22 at the lower part thereof for piercing the axial holes 13, 17 so that the cutting base 20 can be joined to the cutting table 11 pivotally. The cutting table 11 has a locating slit 21 disposed above the shaft 22 for the knife blade 24 being inserted into and fixed in the locating slit 21. The shaft 22 has a flat section 23 at an end thereof to extend outward the lateral cover 12 and insert into an engaging hole 26 of a stir lever 25 so that the flat section 23 can engage with a flat part 27 in the engaging hole 26 for the stir lever 25 being able to actuate the cutting base 20 rotating. The inner wall of the engaging hole 26 has a receiving recess 28 at another end thereof with an opening 29 for a spring piece 30 being disposed in the receiving recess 28 with a tail end 31 of the spring piece 30 holding the wall of the engaging hole 26 via passing through the opening 29. The spring piece 30 provides a hook end 32 at another end thereof to pass through the aperture 18. In this way, the spring piece 30 can keep the stir lever 25 and the cutting base 20 in place.

While the glue tape cutter of the present invention is used for sealing paper boxes, a glue tape 33 is placed on a glue tape base 19 and the glue tape 33 is pulled out to approach the knife blade 24 via the curved substrate 15 and the holding blade 16. Then, the glue tape 33 is pulled backward and cut at position of the knife blade 24 and, right at the moment, the glue tape 33 is pierced by the holding blades 16 due to the pull force. Thus, the glue tape 33 forms a reversed fold part 34 between the holding blade 16 and the knife blade 24. In the meantime, the stir lever 25 actuates the cutting base 20 to rotate such that the reversed fold part 34, which adheres the knife blade 24, bends and allows the glue tape behind the curved substrate 15 keeping contact the cutting table 11 and the cutting base 20 moves the reversed fold part 34. Hence, the reversed fold part 34 sticks together at the curved substrate 15 as a non-glue section. The non-glue section can be held to pull the glue tape out of the cutting table 11 to perform operation of sealing paper boxes. During the operation of sealing paper boxes, the glue tape is cut with the knife blade 24 and the holding blade 16 further pierces the glue tape 33 due to a tension force being exerted to the glue tape 33 at the moment of the glue tape 33 being cut such that the glue tape 33 is further attached to the cutting table 11 for being used next time.

Further, the non-glue section is an initial end of the glue tape, which has been adhered to the paper box, so that it becomes a peeling part in case of the sealed paper box being opened again easily.

It is appreciated that the advantages of the present invention are listed hereinafter:

1. It is not possible to occur the glue tape being adhered to improper spots to decrease waste of the glue tape.

2. It is not necessary to tear apart the glue tape before using so that the work efficiency and the mood of the user can be enhanced.

3. It is convenient for the user to extend the glue tape to avoid the glue tape adhering the hand and rupture resulting from the glue tape being too thin.

4, The sealed glue tape provides a non-adhesive end for being torn apart easily without aid of any tools.

While the invention has been described with referencing to a preferred embodiment thereof, it is to be understood that modifications or variations may be easily made without departing from the spirit of this invention, which is defined by the appended claims.

What is claimed is:

1. A glue tape cutter, comprising a cutting table with two opposite lateral covers, one of the lateral covers having an aperture;

a curved substrate, being disposed at the bottom of the cutting table;

at least a holding blade, being fixed to the cutting table above the curved substrate;

a cutting base, being rotationally attached to the cutting table;

a knife blade, being attached to an upper part of the cutting base;

a shaft, being disposed at a lower part of the cutting base and both ends thereof being attached to the lateral covers respectively, one of the ends extending outward from the lateral cover having the aperture;

a stir lever, providing an end side with an engaging hole engaging with the extending outward end of the shaft for rotating the cutting base, and the inner wall surface of the engaging hole having a receiving recess with an opening; and a spring piece, being disposed in the engaging hole to surround the extending outward end for keeping the stir lever and the cutting base in place;

characterized in that an end of the spring piece passes through the opening to bias against the stir lever and another end of the spring piece is a hook end for passing through and retaining at the aperture of the lateral cover.

* * * * *